US006379537B1

(12) United States Patent
Brieden et al.

(10) Patent No.: US 6,379,537 B1
(45) Date of Patent: Apr. 30, 2002

(54) OIL FILTER WITH SAFETY WALL

(75) Inventors: Thomas Brieden, Waiblingen; Markus Layer, Korb, both of (DE)

(73) Assignee: Mahle Filtersysteme GmbH, Stuttgart (DE)

( * ) Notice: Subject to any disclaimer, the term of this patent is extended or adjusted under 35 U.S.C. 154(b) by 0 days.

(21) Appl. No.: 09/601,066

(22) PCT Filed: Feb. 1, 1999

(86) PCT No.: PCT/DE99/00332

§ 371 Date: Jul. 27, 2000

§ 102(e) Date: Jul. 27, 2000

(87) PCT Pub. No.: WO99/39802

PCT Pub. Date: Aug. 12, 1999

(30) Foreign Application Priority Data

Feb. 4, 1998 (DE) ..... 198 04 329

(51) Int. Cl.[7] ..... F01M 01/00; B01D 35/14

(52) U.S. Cl. ..... 210/90; 210/97; 210/136; 210/168; 210/184; 210/248; 210/443; 123/196 A; 123/196 AB; 184/6.24

(58) Field of Search ..... 210/90, 97, 136, 210/168, 171, 416.5, 184, 186, 232, 348, 440, 443, 450, 455, 248; 184/6.21, 6.24; 123/196 A, 196 AB

(56) References Cited

U.S. PATENT DOCUMENTS 1,896,310 A 2/1933 Hildebrand
3,759,388 A * 9/1973 Thomason
4,831,890 A * 5/1989 Nasu et al.
5,603,829 A * 2/1997 Baumann
5,858,224 A * 1/1999 Schwandt et al.

FOREIGN PATENT DOCUMENTS

| | | |
|---|---|---|
| DE | 30 27 994 | 2/1982 |
| DE | 197 27 470 | 1/1998 |
| DE | 196 35 777 | 3/1998 |
| EP | 0 364 299 | 4/1990 |
| EP | 0 484 710 | 5/1992 |
| EP | 0 492 627 | 7/1992 |
| FR | 2 745 196 | 2/1996 |
| GB | 2 309 397 | 7/1997 |
| WO | WO 88 03432 | 5/1988 |
| WO | WO 97/16234 | 5/1997 |

* cited by examiner

*Primary Examiner*—Joseph W. Drodge
*Assistant Examiner*—Terry K. Cecil
(74) *Attorney, Agent, or Firm*—Collard & Roe, P.C.

(57) ABSTRACT

An oil filter 1 for an internal combustion engine includes a filter body 3 and a plastic filter housing 2. Integrally formed within the filter housing, a safety wall 7 is radially fitted around the feed channel 4 and the return channel 5 creating a collecting space 6 that surrounds both channels. If seal leaks occur when the device is connected to a flange, e.g. of an engine block, the leaked oil will accumulate in the collecting space.

12 Claims, 4 Drawing Sheets

OIL FILTER WITH SAFETY WALL

FIELD OF THE INVENTION

This invention relates to an oil filter for an internal combustion engine.

DESCRIPTION OF THE PRIOR ART

A filter of this type is disclosed in EP 0 492 627. The collecting space is closed so that liquid penetrating into it cannot flow off to the outside.

The publication WO 97/16234 discloses a liquid filter for cleaning oil or fuel, which is flanged onto an engine block of an internal combustion engine. Arranged in the filter housing, which consists of plastic, is a cylindrical filter body whose unfiltered side is acted upon by contaminated liquid which is supplied via a feed channel. The outflow space of the filter body is connected to a return channel via which the cleaned liquid can be taken away out of the filter housing. The feed channel surrounds the return channel annularly, the outer wall of the feed channel being formed by the outer wall of the filter housing. The end-side connections of the feed and return channels are inserted via seals into receptacles on the engine block.

The liquid to be cleaned is guided through the feed channel to the filter body under positive pressure. There is the risk here of leakages occurring in the region of the connection of the filter housing to the engine block, for example as a consequence of material fatigue of the seals, so that unfiltered liquid passes to the outside and can cause contamination or flows inwardly into the return channel and mixes with the liquid which has already been cleaned. In order to reduce this risk, the seals have to be made from very high quality and expensive materials. In addition, even small leakages cause a sharp drop in pressure which means that the minimum pressure required for the filtration cannot be applied and the filtration cannot be carried out.

Because of the large external radius of the feed channel, a large amount of sealing material is needed in order to seal the feed channel, and because of this, in addition to the increased costs, the risk of there being a leakage place also increases and frequent maintenance intervals are required.

SUMMARY OF THE INVENTION

The invention is based on the problem of designing an operationally reliable and low-maintenance, plastic liquid filter of the generic type at low cost, even in the case in which , because of material and/or manufacturing errors, liquid under a high pressure unintentionally penetrates into the collecting space in a greater volume than this space is able to absorb without an increase in pressure. In addition, the filter according to the generic type is to be designed in a form which makes it possible for additional functional parts, such as, in particular, a cooler for the liquid to be filtered, and also pressure sensors to be integrated in a structurally efficient manner.

This problem is already solved in principle according to this invention.

The feed channel and the return channel are situated in a collecting space having a safety wall which is part of the filter housing and surrounds the feed channel and the return channel radially. If the liquid filter is connected to a connecting flange, for example an engine block of an internal combustion engine, the safety in the event of leaky seals is increased because both the inflowing unfiltered liquid and also the outflowing clean liquid are sealed off twice from the environment: within the feed and the return channels and, in addition, within the collecting space whose wall can be connected in a liquid-tight manner to the connecting flange at low cost. In addition, liquid penetrating into the collecting space can flow off through the outlet provided there, as a result of which an undesirably high pressure in the collecting space is reliably avoided. The pressure in the collecting space is restricted to the pressure at its outflow opening.

The collecting space can be configured to atmospheric pressure. The positive pressure in the flow of liquid which is supplied and taken away is completely absorbed by the feed and return channels, respectively. The collecting space remains unaffected by this, and acts as a safety reservoir in the event of leakages occurring. This means that the seal between the safety wall and the connecting flange is not required to be of more exacting quality, that is to say, a simple O-ring seal can be used, for example.

The plastic filter housing can be manufactured by injection moulding in a cast with sufficient dimensional accuracy that finishing is no longer required. In addition, a considerable advantage in terms of weight is obtained. The channels which are formed in the filter housing can be designed such that they have relatively thick walls in order to be able to absorb the pressures prevailing in the liquid; at the same time, the safety wall can be designed such that it has thin walls, since there is no positive pressure in the collecting space.

The connections of the feed channel and of the return channel are advantageously provided with a radial seal in order to obtain, a pressure- and liquid-tight seal between the filter housing and the connecting flange. Retaining forces acting in the axial direction are essentially transmitted via the safety wall of the collecting space, which is free of excess pressure, and in particular via fastening domes which are of reinforced design and in which metal bushings are expediently accommodated, so that the channels are relieved of high axial forces and undesired creeping behaviour of the plastic in the region of the channels is avoided.

The radial seals are preferably of spherical design in order to be able to compensate for axial tolerances.

Because of the connection of the collecting space to a discharge channel, liquid which has emerged into the collecting space, for example from the feed channel or the return channel via leaky radial seals, is conducted away out of the collecting space via the said discharge channel, and, in particular, into the oil sump of the internal combustion engine. As already set out further above, this prevents the collecting space from filling up with liquid and a positive pressure from building up in the collecting space. The discharge channel runs in the connecting flange and is connected to the collecting space via a recess in the connecting flange.

Furthermore, a pressure relief valve can be provided in the collecting space, which pressure relief valve is acted upon by the pressure on the clean side of the filter and when a limiting pressure is exceeded, opens towards the collecting space and thereby causes the pressure to be relieved. The liquid which has emerged into the collecting space is conducted away again out of the collecting space via the discharge channel.

The end sides of the channels respectively each end at a different axial distance, as does a housing receptacle into which the pressure relief valve can be inserted. Assembly is hereby facilitated by the filter housing being placed onto the connecting flange with an approximately uniform, axial assembly force, and first of all the component protruding the furthest, and then the components protruding to a lesser extent, are successively inserted into corresponding receptacles in the connecting flange. This also prevents the filter housing from tilting during assembly.

BRIEF DESCRIPTION OF THE DRAWINGS

Further advantages and expedient embodiments can be gathered from the description of the figures, in which.

DETAILED DESCRIPTION OF THE INVENTION

Figure 1:
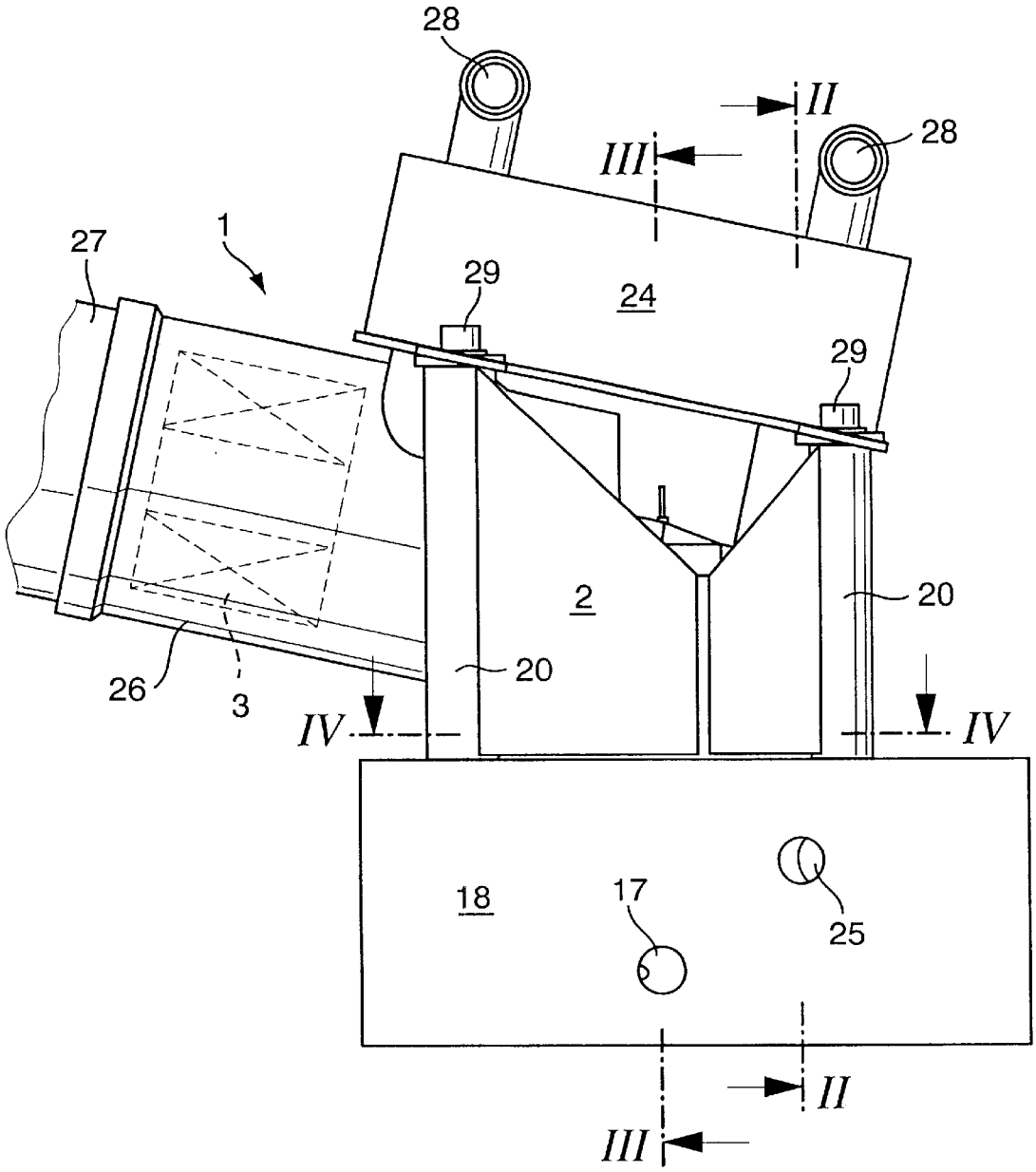
FIG. 1 shows a side view of a liquid filter.

According to FIG. 1, the liquid filter 1, which is expediently inserted in an internal combustion engine in order to filter oil or fuel, is placed with the filter housing 2, which consists of plastic, onto a connecting flange 18, in particular an engine block of an internal combustion engine. The liquid to be cleaned is first of all supplied at positive pressure via the connecting flange 18, through an unfiltered liquid conduit 25, and via a feed channel in the filter housing 2 to an oil cooler 24, which is arranged above the filter 1, and is then conducted through a filter body 3 which is located in a lateral, radially outwardly directed cylindrical section 26 of the filter housing 2. After the cleaning, the clean liquid flows back via a return channel in the filter housing 2 into a clean conduit 17 in the connecting flange 18.

The cylindrical section 26 having the filter body 3 is closed by a removable cover 27. The filter housing 2, the connecting flange 18 and the oil cooler 24 are held together via screws 29 which are guided in fastening domes 20 which are of integral design with the filter housing; in order to increase the stability, metal bushings may be injected into the fastening domes 20. Connections 28 for feeding and taking away heat exchanger medium are arranged on the oil cooler 24. The oil cooler 24 contributes to stabilizing and reinforcing the filter 1.

Figure 2:
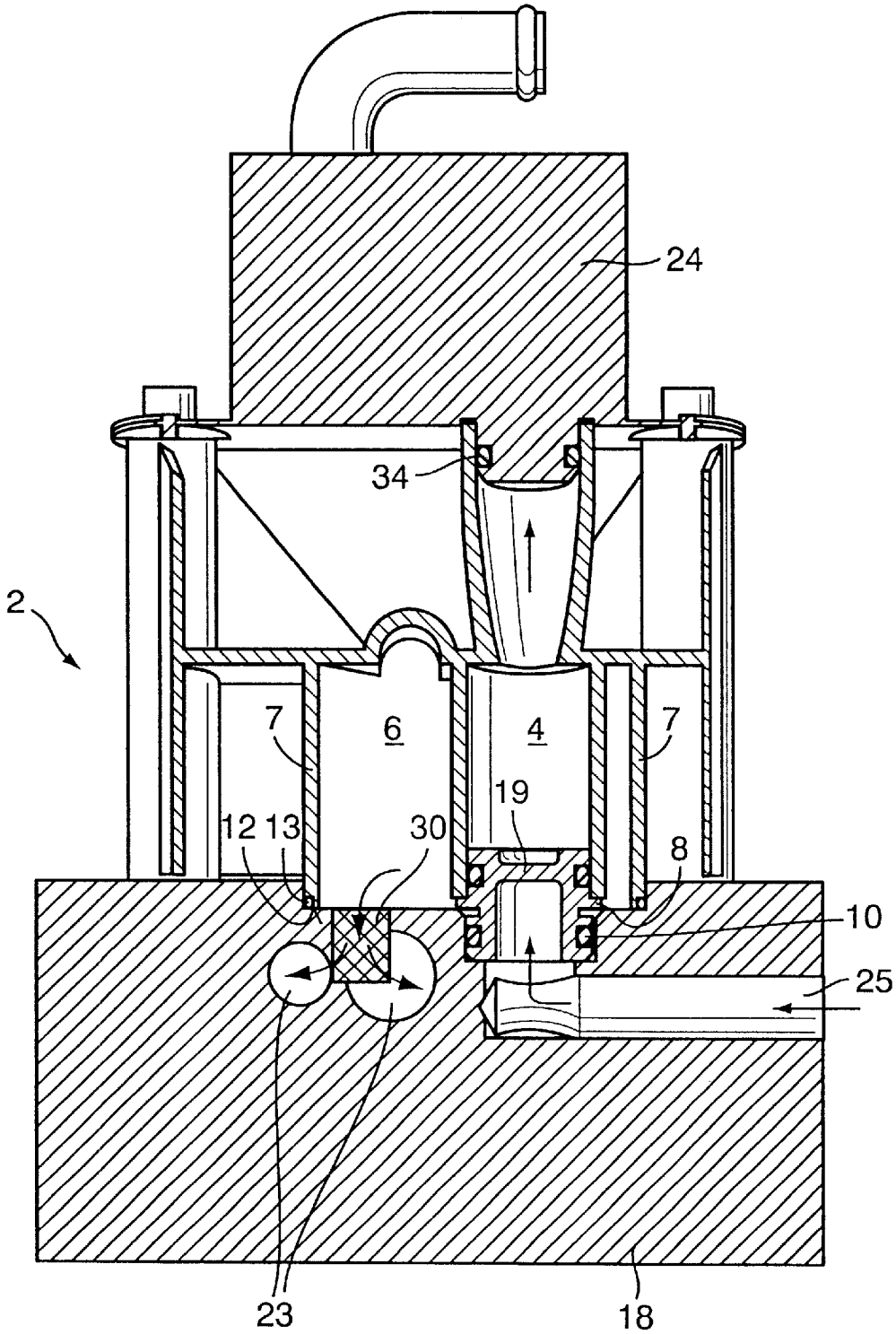
FIG. 2 shows a view along the sectional line II—II from FIG. 1.

The supply of the uncleaned liquid into the filter housing 2 can be seen from FIG. 2. The uncleaned liquid flows via the radially inwardly guided unfiltered liquid conduit 25 in the connecting flange 18 as far as a recess in the connecting flange 18, into which recess is inserted the vertically running feed channel 4 in the filter housing 2. Arranged in the region of the connection 8 of the feed channel 4 is a radial seal 10 which is used to provide a liquid-tight seal between the feed channel 4 and the recess in the connecting flange 18. The radial seal 10 is preferably of spherical design in order to compensate for axial tolerances.

A non-return valve 19 is arranged in the feed channel 4 in order to prevent the liquid to be cleaned from flowing back into the unfiltered liquid conduit 25.

The unfiltered liquid flows further upwards in the arrow direction into the oil cooler 24 in which the liquid is moderated in temperature, i.e. is cooled or heated depending on the application. A radial seal 34 is arranged in the region of the connection of the oil filter 24 to the feed channel 4.

The feed channel 4 lies in an annular collecting space 6 having a safety wall 7 which is part of the filter housing 2 and radially encloses the feed channel 4. The collecting space 6 is of unpressurized design and is connected to a recess 30 in the connecting flange 18, which recess opens into discharge channels 23 which run radially and lead to the oil sump of the internal combustion engine. The discharge channels 23 can run in parallel and can have differing diameters.

The end side 12 of the safety wall 7 engages in a circular cutout on the upper side of the connecting flange 18, an O-ring seal 13 being arranged between the wall of the cutout and the safety wall in the region of the end side 12 of the safety wall 7, in order to seal the collecting space 6 in a liquid-tight manner from the environment.

In the event of a leakage of the feed channel 4, which is enclosed in the collecting space 6, or of the radial seal 10 of the feed channel 4, emerging liquid flows into the unpressurized collecting space 6 and is taken away downwards via the recess 30 and the discharge channel 23. Liquid is thereby prevented from being able to pass into the environment.

Figure 3:
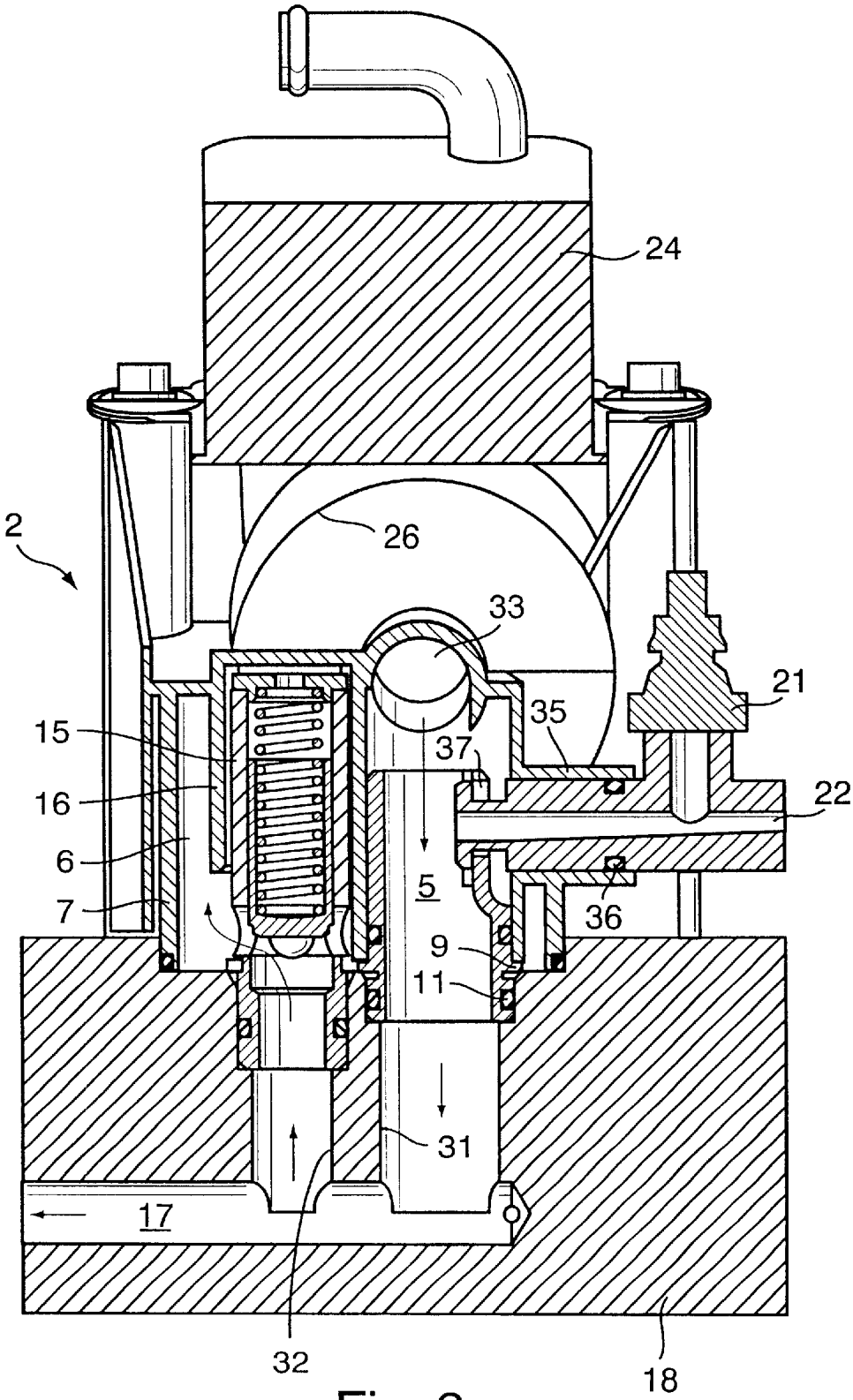
FIG. 3 shows a view along the sectional line III—III from FIG. 1.

The conducting of the liquid away from the filter housing 2 can be seen from FIG. 3. After the liquid is cooled in the oil cooler 24, the liquid is supplied to the filter body in the cylindrical section 26 of the filter housing 2. After filtration, the cleaned liquid flows out of the radially inwardly situated outflow space 33 of the filter body into the return channel 5 which is formed in the filter housing 2 and extends in the vertical direction. The return channel 5 has, in the region of its connection 9, a radial seal 11 which protrudes into a recess 31 in the connecting flange 18 and connects the return channel 5 to the connecting flange 18 in a pressure- and liquid-tight manner. The recess 31 opens into a horizontally running clean conduit 17 via which the cleaned liquid is guided radially out of the connecting flange 18 and, for example when oil is used as the liquid, can be used in order to lubricate bearings.

Protruding radially into the return channel 5 is a connecting piece 22 via which the pressure in the return channel 5 can be supplied to a pressure sensor 21 and to a turbocharger connection.

The connecting piece 22 is inserted into a connecting stub 35 and sealed in this connecting stub via a radial seal 36. The fixing of the connecting piece 22 to the connecting stub 35 can be obtained by a bayonet fastening. This merely requires bayonet-fastening means which can be brought into engagement with one another to be provided on the connecting piece 22 and on the connecting stub 35. The bayonet fastening can, in particular, be designed in such a manner that bit can be closed by latching of the bayonet-fastening means, without the latter having to be rotated towards one another. In the interior of the filter housing 2, the connecting piece 22 serves for fixing the return channel 5. The return channel 5 and the connecting piece 22 are connected by an axial slot 37 being provided at one end of the annular wall of the return channel 5, into which slot a shaped piece emerging from the connecting piece 22 can be inserted in the manner of a snap fastening.

The above-described types of connection between the connecting piece 22 and the connecting stub 35, on the one hand, and between the return channel 5 and the connecting piece 22, on the other hand, mean that in the subject matter according to the invention, only sliding connections which can be produced in a simple manner in terms of manufacturing are present. The pressure sensor 2 can also be advantageously connected to the connecting piece 22 by a sliding connection having a radial seal and a bayonet fastening. Other functional parts can also be connected in a fluid-conducting manner to the filter housing in the same manner.

Arranged parallel to the return channel 5 is a pressure relief valve 15 which sits in a housing receptacle 16, which is formed integrally together with the filter housing 2. In the closed state, the pressure relief valve 15 closes a recess 32 in the connecting flange 18, which recess communicates with the collecting space 6 and connects the collecting space 6 to the clean conduit 17, so that when the pressure relief valve 15 is closed, the connection between the clean conduit 17 and the collecting space 6 is interrupted. Above a limiting pressure in the clean conduit 17 the pressure relief valve 15 opens by the valve body of the pressure relief valve 15, which body is spring-stressed into the closed position, yielding and releasing the connection between the recess 32 and the collecting space 6, so that liquid can flow from the clean conduit 17 into the collecting space 6, and a positive pressure in the clean conduit 17 is reduced. The liquid which has escaped into the collecting space 6 can flow off via the recess 30 in the connecting flange 18, which recess is illustrated in FIG. 2 and communicates with the collecting space 6.

The return channel 5, the housing receptacle 16 and the feed channel 4, which is illustrated in FIG. 2, run parallel to one another. The end sides of the channels 4, 5, of the housing receptacle 16 and expediently of the safety wall 7 advantageously end at a different distance axially.

Figure 4:
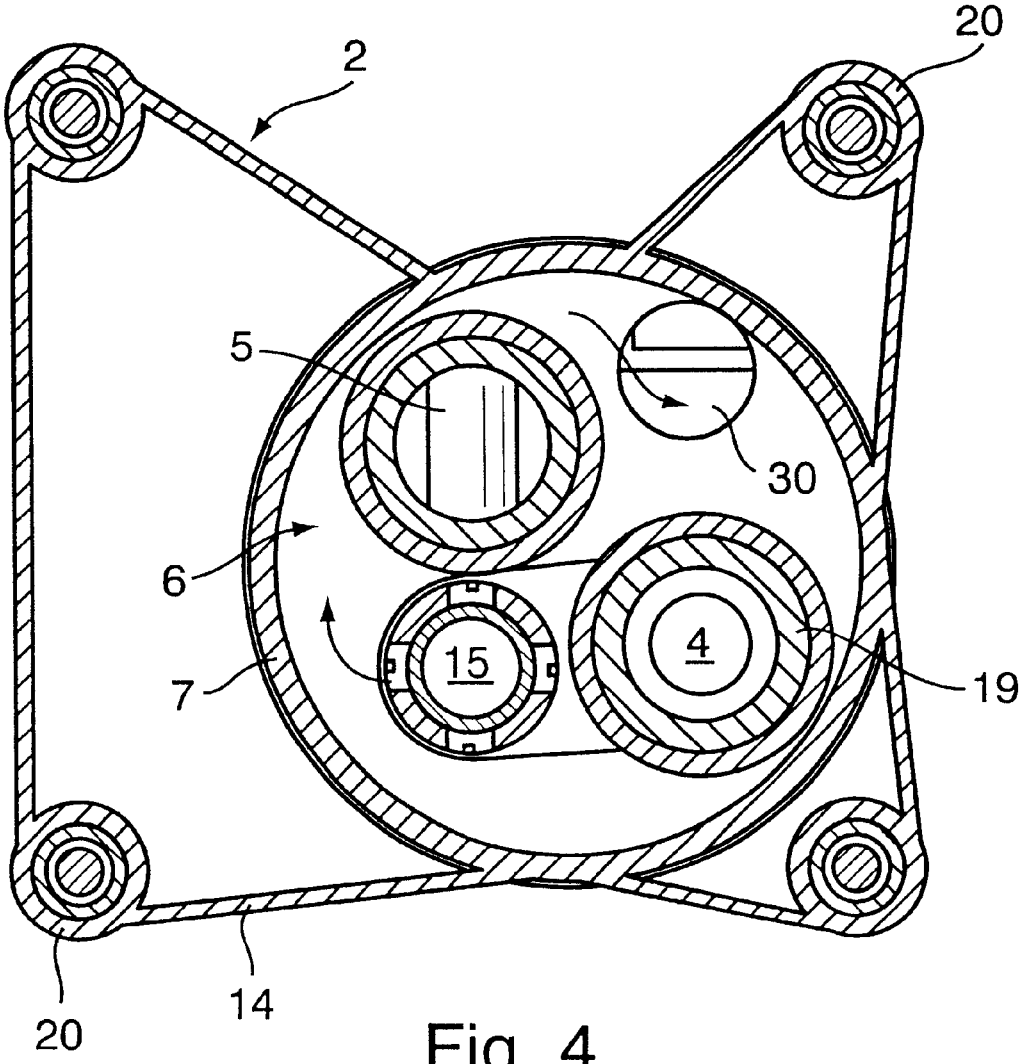
FIG. 4 shows a view along the sectional line IV—IV from FIG. 1.

It can be seen from the illustration according to FIG. 4 that the feed channel 4 having the non-return valve 19, the return channel 5, the pressure relief valve 15 in the housing receptacle 16 (FIG. 3) and the recess 30 in the connecting flange are all situated radially within the cylindrical safety wall 7 which bounds the collecting space 6. In the event of a positive pressure in the clean conduit. 17, which is illustrated in FIG. 3, the liquid flows via the pressure relief valve 15 into the collecting space 6 and flows off again via the recess 30.

The safety wall 7 is situated within a housing outer wall 14. The fastening domes 20 mark corner points in the outer wall 14; a total of four fastening domes 20 together forming a rectangle are provided.

What is claimed is:

1. An oil filter for an internal combustion engine, comprising:

a filter housing made of plastic;

a filter body disposed in the filter housing;

a feed channel for supplying unfiltered oil;

a connecting flange attached to the feed channel, wherein the unfiltered oil enters through the connecting flange into the feed channel;

a return channel for removing clean oil;

a safety wall disposed within the filter housing and radially fitted around the feed channel and the return channel to define a collecting space that surrounds both said channels, wherein the safety wall is integrally formed with the filter housing and is sealed to the connecting flange; and a discharge channel disposed in the collecting space, wherein the feed channel and the return channel are substantially parallel, and an end side of each ends at a different axial distance, and one of said feed channel and return channel axially projects further into the connecting flange.

2. The oil filter according to claim 1, wherein a pressure relief valve (15) which communicates with a clean conduit (17) provided in the connecting flange (18) and opens towards the collecting space (6) is arranged in the collecting space (6).

3. The oil filter according to claim 1, wherein the radial seals (10, 11) are of spherical design.

4. The oil filter according to claim 1, wherein the seal (13), which interacts with the safety wall (7), is effective in the region of an open end side (12) of the safety wall (7).

5. The oil filter according to claim 1, wherein a pressure relief valve (15) is held in a housing receptacle (16) of the filter housing (2).

6. The oil filter according to claim 1, wherein a non-return valve (19) is arranged in the feed channel (4).

7. The oil filter according to claim 1, wherein the filter housing (2) has fastening domes (20) of reinforced design.

8. The oil filter according to claim 6, wherein metal bushings are accommodated in the fastening domes.

9. The oil filter according to claim 1, wherein a pressure sensor (21) is provided to determine the pressure in the return channel (5).

10. The oil filter according to claim 9, wherein a connecting piece (22) which is connected to the return channel (5) is arranged in order to hold the pressure sensor (21).

11. The oil filter according to claim 1, wherein the filter (1) is in fluid communication with an oil cooler (24) for cooling the oil to be cleaned.

12. The oil filter according to claim 11, wherein the fastening of the filter housing (2) to the engine serves at the same time to fasten the oil cooler (24).

* * * * *